United States Patent [19]

Kelly

[11] 4,090,344

[45] May 23, 1978

[54] METHOD AND APPARATUS FOR AUTOMATICALLY FILLING BAGS WITH PARTICULATE MATERIALS

[75] Inventor: Robert C. Kelly, Houston, Tex.

[73] Assignee: General Packaging Equipment Company, Houston, Tex.

[21] Appl. No.: 780,283

[22] Filed: Mar. 23, 1977

[51] Int. Cl.[2] ..... B65B 9/12; B65B 57/10; B65B 37/18

[52] U.S. Cl. ..... 53/28; 53/59 W; 53/167; 53/182 M

[58] Field of Search ..... 53/28, 59 W, 167, 180 M, 53/182 M; 141/10, 83, 128, 192; 177/118, 121, 122, 160, 245

[56] References Cited

U.S. PATENT DOCUMENTS

| | | | |
|---|---|---|---|
| 1,546,360 | 7/1925 | Bates | 141/128 X |
| 3,416,620 | 12/1968 | McClusky | 53/59 W |
| 3,796,021 | 3/1974 | Toss | 53/182 M |

FOREIGN PATENT DOCUMENTS

| | | | |
|---|---|---|---|
| 453,035 | 11/1948 | Canada | 141/83 |

*Primary Examiner*—Robert Louis Spruill
*Attorney, Agent, or Firm*—Bill B. Berryhill

[57] ABSTRACT

Method and apparatus for automatically filling bags with particulate materials in which the method may comprise the steps of: vertically suspending a bag having a sealed bottom and an open top; filling the suspended bag through its open top with particulate materials to near a predetermined net weight; weighing the suspended bag and its contents as the filling continues; terminating the filling of the bag in response to reaching a predetermined net weight; and sealing the top of the bag. The apparatus may comprise: a suspension assembly for vertically suspending the bag; a filler tube through which particulate materials may be dispensed from a central source; weighing apparatus attached to the suspension assembly for indicating the net weight of particulate materials being dispensed into the bag; and control apparatus connected to the weighing apparatus for arresting filling through the filler tube in response to indication from the weighing apparatus that the bag has been filled to its predetermined net weight.

21 Claims, 3 Drawing Figures

METHOD AND APPARATUS FOR AUTOMATICALLY FILLING BAGS WITH PARTICULATE MATERIALS

BACKGROUND OF THE INVENTION

1. Field of the Invention

The present invention pertains to methods and apparatus for filling bags or packages with dry particulate materials. More specifically, it pertains to automatic volumetric auger fill methods and apparatus for filling bags or packages with dry particulate materials.

2. Description of the Prior Art

One of the most modern types of processing machinery for filling bags, packages, pouches, etc. with dry particulate products is the machine referred to as the vertical form-fill-seal machine. With these machines, a flat continuous roll of film or paper may be formed into a tube, sealed at the bottom, filled and then sealed at the top.

There are these principal methods of proportioning dry products for filling bags being formed by vertical form-fill-seal (VFFS) machines. They are:

(1) Volumetric — In this method, products drop from a supply hopper into cups of predetermined volumes. The cups are usually rotated on a plate to another point where the contents of the cup are dropped into the bag. This method is suitable for free-flowing granular products, such as rice, beans, popcorn and peanuts but not accurate for materials which do not flow readily or have a tendency to stick or bridge in the hopper and cups.

(2) Net Weight Scales — This method is used for products of high value. The product is weighed in a bucket prior to being dropped into a bag. It is not suited for use with fine powders, since a considerable portion of the product may stay suspended in the air when dropped from the bucket.

(3) Auger Fill — Auger filling is primarily used for powders, both free-flow and non-free flow. This is a volumetric method in which a given number of revolutions of an auger dispenses a desired volume of products.

The auger fill method is the only practical method of moving non-free flowing powders. However, this method has had a serious drawback in that it is a volumetric process. The accuracy of fill is dependent upon the consistency of the bulk density of the product being processed. Since the density of products may vary considerably, a strictly volumetric auger method may dispense more or less than required.

To overcome this drawback, methods of auger filling and net weight have been combined such as is used in Mateer Model 31-G2 filler manufactured by the Mateer-Burt Company of Wayne, Pa. In this prior art machine, the bag or other container is filled to 90 to 95 percent of the desired weight, strictly volumetricly at a high auger speed. At this point, the auger drive motor is reduced in speed and an electronic weighing system is energized, allowing the final portion to be dribble-filled to the desired weight cut-off point. However, this machine can be used only for pre-formed bags or rigid containers and each bag or container must be manually placed for filling. Thus, the machine is only semi-automatic and requires much more labor and time than the VFFS machines.

SUMMARY OF THE INVENTION

In the method and apparatus of the present invention, auger fill and net weight filling have been utilized as in the previously mentioned semi-automatic Mateer machine. However, unlike the Mateer machine, the method and apparatus of the present invention can be used with a VFFS machine for completely automatic operation.

In the method of the present invention, a bag is formed with a sealed bottom and open top and suspended by the VFFS machine; the suspended bag is filled through its opened top with particulate material to near a predetermined weight; the suspended bag and its contents are weighed as filling continues; filling of the bag is terminated in response to reaching the predetermined net weight; and the top of the bag is sealed. The apparatus for performing the method of the present invention may comprise a suspension assembly, including a forming head, for forming a bag and vertically suspending it therefrom. Weighing apparatus, which may include load cells, is attached to the suspension assembly for indicating the net weight of particulate materials being dispensed to the bag. Control devices are provided and connected to a filling auger and the weighing assembly for arresting operation of the filling auger in response to indication from the weighing assembly that the bag has been filled to its predetermined net weight.

Thus, accurate weighing of the product being dispensed is provided with a VFFS machine utilizing auger fill. The method is both extremely accurate and completely automatic. Other objects and advantages of the invention will become apparent from reading the description which follows in conjunction with the accompanying drawing.

DESCRIPTION OF PREFERRED EMBODIMENTS

Figure 1:
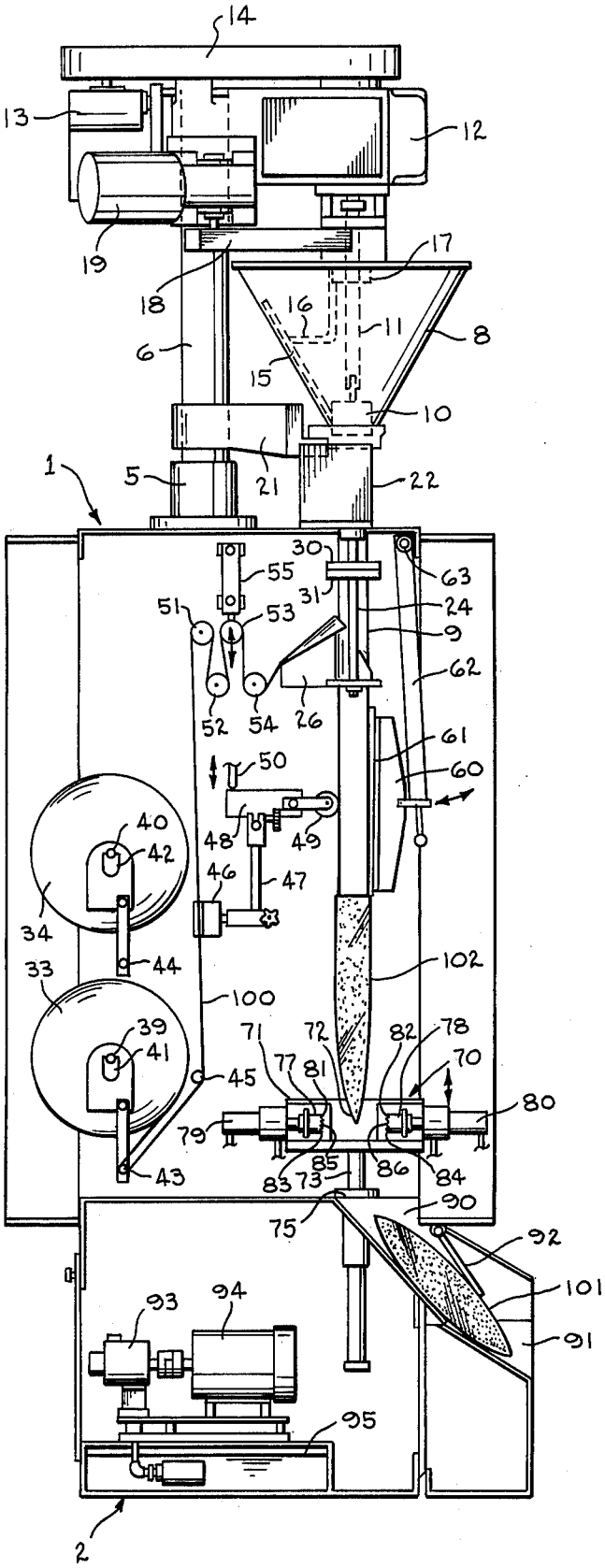
FIG. 1 is a side elevation view, partially broken away, showing a VFFS machine, according to a preferred embodiment of the invention.
Figure 2:
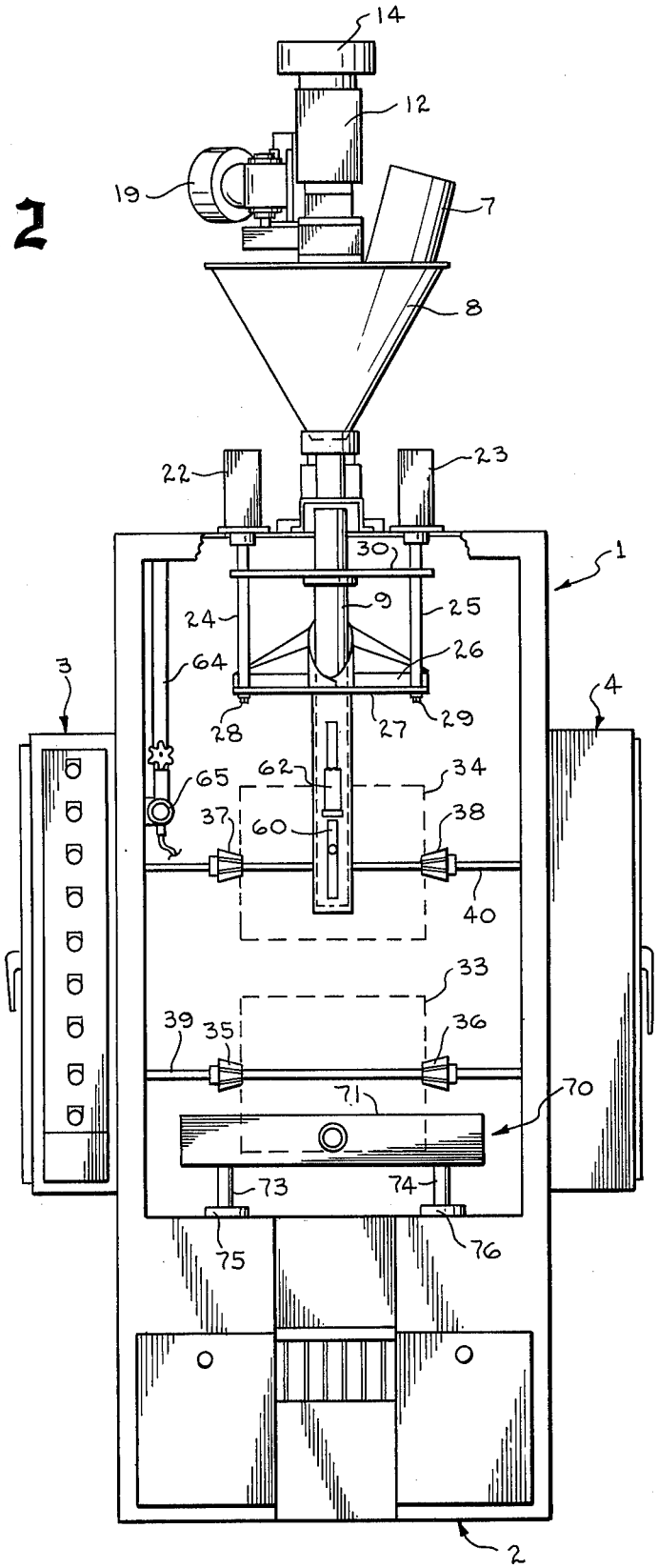
FIG. 2 is a vertical front elevation view of the VFFS machine of FIG. 1.

Referring first to FIGS. 1 and 2, there is shown a vertical form-fill-seal (VFFS) machine, modified according to a preferred embodiment of the invention for forming bags or packages, filling them to a predetermined net weight with dry particulate materials and sealing the bag for further handling. The machine comprises a main housing 1 having a base area 2 and side housings 3 and 4 in which various controls and power components may be mounted.

Surmounted on the housing 1 by a pedestal 5 and column 6 are various components for dispensing dry particulate materials from a central supply source (not shown). These components may include a supply duct 7 through which materials may be transported from the central supply source to a hopper 8. The hopper 8 is supported on column 6 by a cantilever mount 21 which may be vertically adjusted. Connected to the hopper 8 and extending downwardly therefrom is a filler tube 9 through which particulate materials are dispensed to the bag being filled, as will be more fully understood hereafter.

At least partially disposed in the filler tube, for rotation about a common axis, is an auger 10, only the top of which is indicated at the bottom of hopper 8. The auger 10 is connected by a shaft 11 to a pneumatically operated clutch/brake 12 which is in turn connected to an auger drive motor 13 by a belt/pulley assembly 14. It can thus be understood that rotation of the auger 10 is effected by the auger drive motor 13 through the belt assembly 14, clutch/brake 12 and shaft 11. The belt assembly 14 can be provided with different size pulleys so that at least two different speeds of rotation can be provided for the auger 10, one relatively high speed and one relatively low speed. The clutch/brake 12 can be operated so as to prevent the auger 10 from rotating even though the motor 13 continues to run.

Mounted for rotation in the hopper 8 is an agitator blade 15 to prevent materials from bridging or sticking against the side of the hopper 8. The agitator blade 15 is connected by a rotating arm 16 to a hub 17 mounted on a suitable bearing for rotation by chain drive 18 which is connected to agitator motor 19.

Also mounted on the housing 1 is a pair of load cells 22 and 23 from which is suspended by vertical rods 24 and 25 a forming head or former 26 such as is known in the VFFS machine art. The former 26 is provided with a base plate 27 which is attached to the rods 24 and 25 by nuts 28 and 29. a stabilizing cross plate 30 may also be attached to rods 24 and 25 and provided with a central opening through which the filler tube 9 may pass. A flange member 31, affixed to tube 9, may provide a means of attaching the tube 9 to the cross plate 30.

Mounted in the housing is at least one roll 33 of flat sheet bagging material of any suitable type; e.g. polyethylene and other soft films, cello, paper, etc. If desired, an additional roll 34 may be provided as a backup or spare. The bagging material rolls 33 and 34 may be carried on spindles 35, 36, 37, 38 and shafts 39 and 40. The shafts 39 and 40 are supported at their opposite ends by bearing blocks, such as 41 and 42. Associated with the packaging material rolls 33 and 34 are cylindrical idler bars 43, 44, and 45, the function of which will be more clearly understood hereafter.

Also mounted in the housing adjacent the material rolls is a photoelectric register device 46, the purpose of which will be more fully understood hereafter. For the present time, it is sufficient to note that the register device 46 is mounted on a rod 47 for limited vertical adjustment thereon.

Directly above rod 47 is a force reaction unit 48 at the end of which is mounted a reaction wheel 49. During some steps of the method of the present invention, the force reaction unit 48 is in the position shown in FIG. 1 so that wheel 49 bears against tube 9 when any opposing force is brought to bear against the opposite side of tube 9. The force reaction unit 48 is pivotally mounted and during other steps of the method of the present invention, is caused to pivot to the position shown in FIG. 3 by a mechanical linkage 50 so that the wheel 49 does not engage or bear against tube 9. This will be more fully understood hereafter.

Directly above the force reaction unit 48 is a series of cylindrical idler bars 51, 52, 53 and 54. The axes of these idler bars, except for 53, are essentially fixed. However, the idler bar 53 is attached to hydraulic cylinders 55 so that its axis can be vertically displaced, as indicted by the two-headed arrow thereon. The mechanical linkage 50 just previously mentioned with reference to force reaction unit 48, also moves in response to actuation of the cylinders 55, as indicated by the two-headed arrow shown just to the left of linkage 50.

Figure 3:
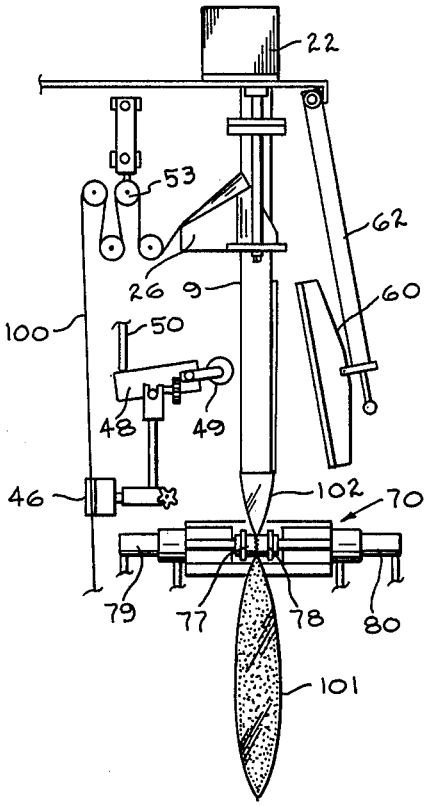
FIG. 3 is a partial side elevation view, similar to FIG. 1, but showing some of the apparatus in different positions for different steps of the method of the invention.

Also supported in the housing is a backseal bar 60 which may be provided with a heating element 61, the purpose of which will be more fully understood hereafter. The backseal bar 60 is mounted on a rod 62 for pivoting about axis 63 so that the backseal bar 60 can move from the position shown, in contact with tube 9, to a position away from the tube 9, as indicated by the two-headed arrow at backseal bar 60 and as is shown in FIG. 3. Pivoting of rod 62 is provided by mounting the rod on a rotating shaft, whose axis coincides with pivot axis 63. The shaft extends horizontally to the side of the housing 1 where another rod 64 is attached for projection to and connection with the rod of a hydraulic piston unit 65. The axis of the rod of piston unit 65 is horizontal and it can be understood that actuation of the piston unit 65 will cause pivoting of rods 64 and 62 about the axis 63 of the horizontal rod.

Directly below filler tube 9 is a sealing platen or jaw assembly 70. The jaw assembly 70 includes an oval frame 71 having an elongated vertical opening 72 therethrough. The frame 71 is supported at opposite ends by vertical rods 73 and 74 which pass through bearing hubs 75 and 76, respectively. The rods 73 and 74 are reciprocal within the bearing hubs 75 and 76 so that the jaw assembly 70 can move from a lower terminal position, as shown in FIGS. 1 and 2, to an upper terminal position, as shown in FIG. 3, as indicated by the two-headed arrow above the assembly 70. These rods 73 and 74 can be moved in any suitable manner as is known in the art, e.g. hydraulic pistons, crank mechanisms, etc.

Mounted in the jaw frame 71 is a pair of opposing jaws 77 and 78 for reciprocal movement by hydraulic cylinders 79 and 80 towards and away from each other. Each jaw 77 and 78 is provided with horizontal upper sealing surfaces 81 and 82, lower sealing surfaces 83 and 84, and knife surfaces 85 and 86, respectively. The operation of the jaws 77 and 78 will be more fully described hereafter.

Directly below the opening 72 of the jaw assembly 70 is a chute 90 which connects with an outlet 91. A hinged gate 92 may be provided between the chute and outlet.

The base 2 of the housing may provide space for components such as a hydraulic pump 93, motor 94 and hydraulic reservoir 95. These components may provide the hydraulic power necessary for operation of the various components of the machine. Other hydraulic, pneumatic, or electrical power and control components may be mounted inside housings 3 and 4.

Referring now to FIGS. 1, 2 and 3, the method of the present invention will be described. Initially, the leading edge of film 100 is unrolled from the material roll 33, fed around idler bars 43 and 45, through the photoelectric register 46. The purpose of the register 46 is to assure that printed material on the film 100 will be properly aligned as bags are formed out of the film 100. To assure this, a registration index is provided on the film which when sensed by the register 46 will stop the movement of the film 100 at proper points within the cycle to assure that the printing will appear as desired on the finished bags which are filled with the dry particulate products.

From the register 46 the film 100 is fed around idler bars 51, 52, 53, and 54 as indicated. These idler bars, particularly 53, assure that proper tension is maintained on the film during the process. From the last idler bar 54, the film enters the former 26 where its outer edges are brought together, in a fashion known in the art, around the filler tube 9, slightly overlapping each other and forming a film tube around the filler tube 9. At appropriate times, the backseal bar 60 and its heating element 61 are pressed against the longitudinal seam formed by the overlapping of the film edges and heat is applied to seal these edges together. Depending on the type of packaging material being used, the sealing may be accomplished by impulse heating or static heating. As pressure is applied to the film tube and the filling tube 9, the force reacts against wheel 49 of the reaction unit 48 so that the force is offset preventing damage to or misalignment of the filler tube 9.

Once operation has commenced, and at approximately the same time that the longitudinal seam is being sealed, the jaw assembly 70 is moved to its upper terminal position and the jaws 77 and 78 move inwardly to grip the film tube suspending from filler tube 9, creating the bottom of a bag 102, as shown in FIG. 3. The sealing surfaces 81 and 82 are provided with heat so that the bottom of the bag is sealed.

At about this time in the cycle, the backseal bar 60 is pivoted away from filler tube 9, as shown in FIG. 3, and the film 100 and newly formed bag 102 are pulled downwardly by the jaw assembly 70 essentially to the position shown in FIG. 1. As the bag 102 is pulled downwardly, the clutch/brake 12 is engaged causing the auger 10 within the filler tube 9 to be driven by auger motor 13, volumetricly dispensing particulate materials from the hopper 8 into the bag 102. After a predetermined number of revolutions of the auger 10, and as the bag 102 approaches, say 90 or 95 percent of, its required net weight, the speed of the auger 10 is reduced to a substantially slower RPM. At about this point in time, the jaws 77 and 78 are retracted, allowing the lower bag 101 to fall into chute 90 for further handling and leaving bag 102 suspended as shown in FIG. 1 filled with product to a point approaching its predetermined net weight.

At approximately the same time, the cylinders 55 are actuated, causing idler bar 53 to move downwardly, relieving tension of film 100, and causing reaction unit 48 to pivot so that wheel 49 disengages the film surrounding filler tube 9. Thus, all that is now suspended from the load cells 22 and 23 are partially filled bag 102, former 26 and a small additional amount of film. At this point, the load cells 22 and 23 are activated indicating a tare weight of the film, former 26 and partially filled bag 102. Since the weight of the film and former 26 are known, these can be automatically subtracted from the tare weight resulting in the net weight within bag 102.

Since the auger 10 is now rotating at a relatively slow speed, product is dribble fed into the bag 102 until the predetermined net weight of the bag is reached. At this point, the clutch/brake 12 is disengaged, causing the auger 10 to stop. At about the same time, the jaw assembly 70 is moved upwardly to its upper terminal position and jaws 77 and 78 moved inwardly to engage the film 100 at the top of bag 102 and the bottom of the next to be formed bag. The top of bag 102 is sealed by sealing surfaces 83 and 84 while the knife surfaces 85 and 86 actually separate the film between the top of bag 102 and the bottom of the next to be formed bag. The bottom of the next to be formed bag is then sealed as was previously described with reference to bag 102. During the sealing and cutting operation, the load cells 22 and 23 are again deactivated, cylinder 55 is retracted, placing proper tension on film 100, reaction unit 48 is returned to its reaction position in which wheel 49 engages filler tube 9 and backseal bar 60 is returned against filler tube 9 so that the longitudinal seam of the bag to be formed is sealed.

Then the backseal bar 60 and reaction unit 48 are pivoted away from filler tube 9 while the jaw assembly 70 is returned to the lower terminal position, pulling the newly bottom sealed bag above bag 102 downwardly as the clutch/brake 12 is engaged and product dispensed thereinto by auger 10. Thus the cycle continues, forming bag after bag of sealed product with an accurately determined net weight.

Although many components of the just described machine and several steps of the method are known in the art, there are unique distinctions. The load cells 22 and 23 and the way in which the bag being filled is suspended from the load cells is unique in the art. None of the machines or methods of the prior art combine net weighing with auger filling in such a manner as to provide packages or bags so accurately filled with product and in such an efficient completely automatic process.

Although only one embodiment of the invention has been described herein, many variations thereof can be made by those skilled in the art without departing from the spirit of the invention. Therefore, it is intended that the scope of the invention be limited only by the claims which follow.

I claim:

1. A method of automatically forming and filling bags with particulate materials comprising the steps of:

providing a continuous supply of bagging material;

feeding said bagging material through former means to form a tube of bagging material suspended from said former means;

sealing the sides and bottom of a portion of said bagging material to form a top opened bag in communication with a source of particulate materials;

dispensing particulate materials into said bag to near a predetermined net weight;

weighing said bag and particulate materials by suspending said former means and said bag from weigh means as said dispensing continues;

terminating said dispensing in response to reaching said predetermined net weight; and sealing the top of said bag and separating said bag from said continuous supply of bagging material.

2. The method of claim 1 in which said continued dispensing as said bag and its contents are weighed is conducted at a substantially slower rate than said dispensing to near said predetermined net weight.

3. The method of claim 2 in which said weighing means is activated upon said continued dispensing at said slower rate.

4. The method of claim 3 in which said dispensing is accomplished by auger means, the speed of said auger means being reduced during said weighing of said bag and its contents.

5. The method of claim 1 in which, after said dispensing into and sealing of said bag, subsequent bags are continuously formed and suspended for filling as set forth in claim 1.

6. The method of claim 5 in which said first bag is substantially simultaneously separated from said continuous supply of bagging material, as its top is sealed, for further handling.

7. The method of claim 6 in which the bottom of a second bag is sealed substantially simultaneously with said sealing of said first bag top.

8. The method of claim 1 in which said dispensing is conducted by volumetric auger filling, initially at a first rate, said continued dispensing during said weighing of said bag being conducted at a second slower rate.

9. The method of claim 1 in which the bottom of said bag is gripped and displaced downwardly by placing tension thereon during at least a portion of said dispensing.

10. The method of claim 9 in which tension is relieved from said bag during said weighing thereof.

11. Apparatus for automatically forming bags from a continuous supply of bagging material and filling said bags with particulate materials to a predetermined net weight comprising:

housing means;

former means disposed within said housing means and through which said bagging material may be fed to form a tube of bagging material;

filler tube means supported by said housing means and around which a portion of said bagging material tube is disposed;

sealing means mounted on said housing means and engageable with said bagging material tube for sealing said tube to form the bottom of a top opened bag;

filler means connected to said filler tube means for forcing particulate materials therethrough for dispensing into said top opened bag; and weigh means mounted on said housing means and from which said former means and said top opened bag is suspended for indicating the net weight of particulate materials being dispensed into said bag.

12. Apparatus as set forth in claim 11 in which said weigh means comprises at least one load cell from which said suspension means and said bag are suspended.

13. Apparatus as set forth in claim 11 in which said filling means comprises an auger filler connected to said filler tube, said auger filler being capable of rotating at a first speed as particulate materials are first dispensed to said bag, rotation of said auger filler being arrestable in response to said indication that said bag has been filled to a predetermined net weight.

14. Apparatus as set forth in claim 13 in which said auger filler is capable of rotating at a second reduced speed when said bag approaches said predetermined net weight.

15. Apparatus as set forth in claim 14 in which said weigh means is activatable when said auger filler begins to rotate at said second reduced speed.

16. Apparatus as set forth in claim 11 including second sealing means mounted on said housing means and engageable with said top opened bag after deactivation of said filler means for closing and sealing the top of said filled bag.

17. Apparatus as set forth in claim 16 in which said first and second sealing means are carried on a sealing frame reciprocable between lower and upper terminal positions.

18. Apparatus as set forth in claim 16 including knife means engageable with said tube of bagging material above said sealed top of said filled bag to separate said filled bag from said continuous supply of bagging material.

19. Apparatus as set forth in claim 11 including tension means engageable with the bottom of said top opened bag for displacing said bag downwardly by placing a tension thereon.

20. Apparatus as set forth in claim 19 in which said tension means is disengageable from said bag to remove said tension thereon so as to not affect indication of said net weight by said weigh means.

21. Apparatus as set forth in claim 11 in which said filler means comprises an auger rotatable at at least a first speed and a second slower speed.

* * * * *